US007576294B2

(12) United States Patent
Clemens et al.

(10) Patent No.: US 7,576,294 B2
(45) Date of Patent: Aug. 18, 2009

(54) MECHANICAL CONTROL ELEMENTS FOR ORGANIC POLYMER ELECTRONIC DEVICES

(75) Inventors: Wolfgang Clemens, Puschendorf (DE); Jürgen Ficker, Erlangen (DE); Alexander Friedrich Knobloch, Erlangen (DE); Andreas Ullmann, Zirndorf (DE)

(73) Assignee: PolyIC GmbH & Co. KG, Furth (DE)

( * ) Notice: Subject to any disclaimer, the term of this patent is extended or adjusted under 35 U.S.C. 154(b) by 650 days.

(21) Appl. No.: 10/570,571

(22) PCT Filed: Aug. 31, 2004

(86) PCT No.: PCT/DE2004/001929

§ 371 (c)(1),
(2), (4) Date: Mar. 2, 2006

(87) PCT Pub. No.: WO2005/024870

PCT Pub. Date: Mar. 17, 2005

(65) Prior Publication Data

US 2007/0008019 A1 Jan. 11, 2007

(30) Foreign Application Priority Data

Sep. 3, 2003 (DE) ..... 103 40 644

(51) Int. Cl.
*H01H 13/704* (2006.01)

(52) U.S. Cl. ..... 200/512; 341/34

(58) Field of Classification Search ..... 200/5 A, 200/511, 512, 600; 341/22, 33, 34; 345/168, 345/169, 173, 174
See application file for complete search history.

(56) References Cited

U.S. PATENT DOCUMENTS

| | | | |
|---|---|---|---|
| 3,512,052 | A | 5/1970 | MacIver et al. |
| 3,769,096 | A | 10/1973 | Ashldn |
| 3,955,098 | A | 5/1976 | Kawamoto |
| 3,999,122 | A | 12/1976 | Winstel et al. |
| 4,246,298 | A | 1/1981 | Guarnery |
| 4,302,648 | A | 11/1981 | Sado et al. |
| 4,340,057 | A | 7/1982 | Bloch |
| 4,442,019 | A | 4/1984 | Marks |
| 4,554,229 | A | 11/1985 | Small |
| 4,865,197 | A | 9/1989 | Craig |
| 4,926,052 | A | 5/1990 | Hatayama |
| 4,937,119 | A | 6/1990 | Nikles et al. |
| 5,075,816 | A | 12/1991 | Stormbom |
| 5,173,835 | A | 12/1992 | Cornett et al. |

(Continued)

FOREIGN PATENT DOCUMENTS

| | | |
|---|---|---|
| DE | 33 38 597 | 5/1985 |

(Continued)

OTHER PUBLICATIONS

U.S. Appl. No. 10/344,926, filed Feb. 12, 2004, Bernds et al.

(Continued)

*Primary Examiner*—Michael A Friedhofer
(74) *Attorney, Agent, or Firm*—Carella, Byrne, etal; Elliot M. Olstein; William Squire

(57) ABSTRACT

A switching element for polymer electronic devices is constructed from organic materials.

16 Claims, 3 Drawing Sheets

U.S. PATENT DOCUMENTS 5,206,525 A 4/1993 Yamamoto et al.
5,259,926 A 11/1993 Kuwabara et al.
5,321,240 A 6/1994 Takahira
5,347,144 A 9/1994 Garnier et al.
5,364,735 A 11/1994 Akamatsu
5,395,504 A 3/1995 Hoffman et al.
5,480,839 A 1/1996 Ezawa et al.
5,486,851 A 1/1996 Gehner et al.
5,502,396 A 3/1996 Desarzens
5,546,889 A 8/1996 Wakita et al.
5,569,879 A 10/1996 Gloton
5,574,291 A 11/1996 Dodabalapur et al.
5,578,513 A 11/1996 Maegawa
5,580,794 A 12/1996 Allen
5,625,199 A 4/1997 Baumbach et al.
5,629,530 A 5/1997 Brown et al.
5,630,986 A 5/1997 Charlton
5,652,645 A 7/1997 Jain
5,691,089 A 11/1997 Smayling
5,693,956 A 12/1997 Shi
5,705,826 A 1/1998 Aratani et al.
5,729,428 A 3/1998 Sakata et al.
5,854,139 A 12/1998 Kondo et al.
5,869,972 A 2/1999 Birch et al.
5,883,397 A 3/1999 Isoda et al.
5,892,244 A 4/1999 Tanaka et al.
5,946,551 A 8/1999 Dimitrakopoulos
5,967,048 A 10/1999 Fromson et al.
5,970,318 A 10/1999 Choi et al.
5,973,598 A 10/1999 Beigel
5,997,817 A 12/1999 Crismore et al.
5,998,805 A 12/1999 Shi et al.
6,036,919 A 3/2000 Thym et al.
6,045,977 A 4/2000 Chandross et al.
6,060,338 A 5/2000 Tanaka et al.
6,072,716 A 6/2000 Jacobson et al.
6,083,104 A 7/2000 Choi
6,087,196 A 7/2000 Sturm et al.
6,133,835 A 10/2000 DeLeeuw et al.
6,150,668 A 11/2000 Bao
6,180,956 B1 1/2001 Chondroudis
6,197,663 B1 3/2001 Chandross
6,207,472 B1 3/2001 Calligari et al.
6,215,130 B1 4/2001 Dodabalapur
6,221,553 B1 4/2001 Wolk
6,251,513 B1 6/2001 Rector
6,284,562 B1 9/2001 Batlogg et al.
6,300,141 B1 10/2001 Segal et al.
6,321,571 B1 11/2001 Themont et al.
6,322,736 B1 11/2001 Bao
6,329,226 B1 12/2001 Jones
6,329,617 B1 * 12/2001 Burgess ..... 200/61.43
6,330,464 B1 12/2001 Colvin
6,335,539 B1 1/2002 Dimitrakopoulos et al.
6,340,822 B1 1/2002 Brown et al.
6,344,662 B1 2/2002 Dimitrakopoulos et al.
6,362,509 B1 3/2002 Hart
6,384,804 B1 5/2002 Dodabalapur et al.
6,403,396 B1 6/2002 Gudesen et al.
6,429,450 B1 8/2002 Mutsaers et al.
6,469,267 B1 * 10/2002 Welsh et al. ..... 200/512
6,498,114 B1 12/2002 Amundson et al.
6,517,995 B1 2/2003 Jacobsen et al.
6,518,949 B2 2/2003 Drazic
6,521,109 B1 2/2003 Bartic et al.
6,548,875 B2 4/2003 Nishiyama
6,555,840 B1 4/2003 Hudson
6,593,690 B1 7/2003 McCormick
6,603,139 B1 8/2003 Tessler
6,621,098 B1 9/2003 Jackson
6,809,280 B2 * 10/2004 Divigalpitiya et al. ..... 200/512
6,852,583 B2 2/2005 Bernds et al.
6,858,811 B2 * 2/2005 Fitzgerald et al. ..... 200/85 R
6,903,958 B2 6/2005 Bernds et al.
6,960,489 B2 11/2005 Bernds et al.
7,022,397 B2 * 4/2006 Furuya et al. ..... 428/141
7,196,281 B2 * 3/2007 Cok et al. ..... 200/512
7,258,469 B2 * 8/2007 Manico et al. ..... 362/394
7,291,795 B2 * 11/2007 Maharshak et al. ..... 200/292
7,342,190 B2 * 3/2008 Burgess et al. ..... 200/61.43
7,371,985 B2 * 5/2008 Chen ..... 200/302.1
7,397,466 B2 * 7/2008 Bourdelais et al. ..... 345/173
7,468,199 B2 * 12/2008 Divigalpitiya et al. ..... 428/40.1
2002/0018911 A1 2/2002 Bernius et al.
2002/0022284 A1 2/2002 Heeger
2002/1025391 2/2002 Angelopoulos
2002/0053320 A1 5/2002 Duthaler
2002/0056839 A1 5/2002 Joo et al.
2002/0068392 A1 6/2002 Lee et al.
2002/1130042 9/2002 Stiene
2002/0170897 A1 11/2002 Hall
2002/0195644 A1 12/2002 Dodabalapur et al.
2003/0059987 A1 3/2003 Sirringhaus et al.
2003/0112576 A1 6/2003 Brewer et al.
2004/0002176 A1 1/2004 Xu
2004/0013982 A1 1/2004 Jacobson et al.
2004/0026689 A1 2/2004 Bernds et al.
2004/0084670 A1 5/2004 Tripsas et al.
2004/0211329 A1 10/2004 Funahata et al.

FOREIGN PATENT DOCUMENTS

DE 692 32 740 T2 4/1993
DE 424 38 32 6/1994
DE 198 52 312 5/1999
DE 198 16 860 11/1999
DE 199 18 193 11/1999
DE 198 51 703 5/2000
DE 100 06 257 9/2000
DE 199 21 024 11/2000
DE 199 33 757 1/2001
DE 695 19 782 1/2001
DE 199 35 527 2/2001
DE 199 37 262 3/2001
DE 100 12 204 9/2001
DE 100 33 112 1/2002
DE 100 43 204 4/2002
DE 100 45 192 4/2002
DE 100 47 171 4/2002
DE 100 58 559 5/2002
DE 100 61 297 6/2002
DE 101 17 663 10/2002
DE 101 20 687 10/2002
DE 101 20 686 11/2002
DE 102 19 905 12/2003
EP 0 108 650 5/1984
EP 0 128 529 12/1984
EP 0 268 370 A2 5/1988
EP 0 268 370 A3 5/1988
EP 0 350 179 1/1990
EP 0 418 504 3/1991
EP 0 442 123 8/1991
EP 0 460 242 12/1991
EP 0 501 456 A2 9/1992
EP 0 501 456 A3 9/1992
EP 0 511 807 11/1992
EP 0 528 662 2/1993
EP 0 603 939 A2 6/1994
EP 0 685 985 12/1995
EP 0 716 458 6/1996
EP 0 785 578 A2 7/1997
EP 0 785 578 A3 7/1997
EP 0 786 820 7/1997
EP 0 615 256 9/1998

| | | | |
|---|---|---|---|
| EP | 0 690 457 | | 12/1999 |
| EP | 0 962 984 | | 12/1999 |
| EP | 0 966 182 | | 12/1999 |
| EP | 0 979 715 | | 2/2000 |
| EP | 0 981 165 | | 2/2000 |
| EP | 0 989 614 | A2 | 3/2000 |
| EP | 1 048 912 | | 11/2000 |
| EP | 1 052 594 | | 11/2000 |
| EP | 1 065 725 | A2 | 1/2001 |
| EP | 1 065 725 | A3 | 1/2001 |
| EP | 1 083 775 | | 3/2001 |
| EP | 1 102 335 | A2 | 5/2001 |
| EP | 1 103 916 | | 5/2001 |
| EP | 1 104 035 | A2 | 5/2001 |
| EP | 1 134 694 | | 9/2001 |
| EP | 1 224 999 | | 7/2002 |
| EP | 1 237 207 | | 9/2002 |
| EP | 1 318 084 | | 6/2003 |
| FR | 2793089 | | 11/2000 |
| GB | 723598 | | 2/1955 |
| GB | 2 058 462 | | 4/1981 |
| GB | 2001P20024 | | 8/2000 |
| GB | 2001P03239 | | 1/2001 |
| JP | 54069392 | | 6/1979 |
| JP | 60117769 | | 6/1985 |
| JP | 61001060 | | 1/1986 |
| JP | 61167854 | | 7/1986 |
| JP | 62065472 | A | 3/1987 |
| JP | 362065477 | A | 3/1987 |
| JP | 01169942 | | 7/1989 |
| JP | 2969184 | | 12/1991 |
| JP | 03290976 | A | 12/1991 |
| JP | 05259434 | | 10/1993 |
| JP | 05347422 | | 12/1993 |
| JP | 08197788 | | 8/1995 |
| JP | 09083040 | | 3/1997 |
| JP | 09320760 | | 12/1997 |
| JP | 10026934 | | 1/1998 |
| JP | 2001085272 | | 3/2001 |
| WO | WO 93/16491 | | 8/1993 |
| WO | WO 94/17556 | | 8/1994 |
| WO | WO 95/06240 | | 3/1995 |
| WO | WO 95/31831 | | 11/1995 |
| WO | WO 96/02924 | | 2/1996 |
| WO | WO 96/19792 | | 6/1996 |
| WO | WO 97/12349 | | 4/1997 |
| WO | WO 97/18944 | | 5/1997 |
| WO | WO 98/18156 | | 4/1998 |
| WO | WO 98/18186 | | 4/1998 |
| WO | WO 98/40930 | | 9/1998 |
| WO | WO 99/07189 | | 2/1999 |
| WO | WO 99/10929 | | 3/1999 |
| WO | WO 99/10939 | | 3/1999 |
| WO | WO 99/21233 | | 4/1999 |
| WO | WO 99/30432 | | 6/1999 |
| WO | WO 99/39373 | | 8/1999 |
| WO | WO 99/40631 | | 8/1999 |
| WO | WO 99/53371 | | 10/1999 |
| WO | WO 99/54936 | | 10/1999 |
| WO | WO 99/66540 | | 12/1999 |
| WO | WO 00/33063 | | 6/2000 |
| WO | WO 00/36666 | | 6/2000 |
| WO | WO 00/79617 | | 12/2000 |
| WO | WO 01/03126 | | 1/2001 |
| WO | WO 01/06442 | | 1/2001 |
| WO | WO 01/08241 | | 2/2001 |
| WO | WO 01/15233 | | 3/2001 |
| WO | WO 01/17029 | | 3/2001 |
| WO | WO 01/17041 | | 3/2001 |
| WO | WO 01/27998 | | 4/2001 |
| WO | WO 01/46987 | | 6/2001 |
| WO | WO 01/47044 | A2 | 6/2001 |
| WO | WO 01/47044 | A3 | 6/2001 |
| WO | WO 01/47045 | | 6/2001 |
| WO | WO 01/73109 | A2 | 10/2001 |
| WO | WO 01/73109 | A3 | 10/2001 |
| WO | WO 02/05360 | | 1/2002 |
| WO | WO 0205361 | | 1/2002 |
| WO | WO 02/15264 | | 2/2002 |
| WO | WO 02/19443 | | 3/2002 |
| WO | WO 02/29912 | | 4/2002 |
| WO | WO 02/43071 | | 5/2002 |
| WO | WO 02/47183 | | 6/2002 |
| WO | WO 02/065557 | A1 | 8/2002 |
| WO | WO 02065557 | A1 | 8/2002 |
| WO | WO 02/071139 | | 9/2002 |
| WO | WO 02/071505 | | 9/2002 |
| WO | WO 02/076924 | | 10/2002 |
| WO | WO 02/091495 | | 11/2002 |
| WO | WO 02/095805 | A2 | 11/2002 |
| WO | WO 02/095805 | A3 | 11/2002 |
| WO | WO 02/099907 | | 12/2002 |
| WO | WO 02/099908 | | 12/2002 |
| WO | WO 03/046922 | | 6/2003 |
| WO | WO 03/067680 | | 8/2003 |
| WO | WO 03/069552 | | 8/2003 |
| WO | WO 03/081671 | | 10/2003 |
| WO | WO 03/095175 | | 11/2003 |
| WO | WO 2004/032257 | | 4/2004 |
| WO | WO 2004/042837 | | 5/2004 |
| WO | WO 2004/042837 | A2 | 5/2004 |
| WO | WO 2004/042837 | A3 | 5/2004 |
| WO | WO 2004/007194 | A2 | 6/2004 |
| WO | WO 2004/007194 | A3 | 6/2004 |
| WO | WO 2004/047144 | A2 | 6/2004 |
| WO | WO 2004/047144 | A3 | 6/2004 |
| WO | WO 2004/083859 | | 9/2004 |

OTHER PUBLICATIONS

U.S. Appl. No. 10/344,951, filed Feb. 12, 2004, Bernds et al.
U.S. Appl. No. 10/380,113, filed Sep. 25, 2003, Bernds et al.
U.S. Appl. No. 10/381,032, filed Feb. 12, 2004, Bernds et al.
U.S. Appl. No. 10/433,959, filed Apr. 1, 2004, Bernds.
U.S. Appl. No. 10/433,961, filed Apr. 1, 2004, Clemens et al.
U.S. Appl. No. 10/451,108, filed May 13, 2004, Giles et al.
U.S. Appl. No. 10/467,636, filed Nov. 4, 2004, Bernds et al.
U.S. Appl. No. 10/473,050, filed May 20, 2004, Bernds et al.
U.S. Appl. No. 10/479,234, filed Dec. 30, 2004, Bernds et al.
U.S. Appl. No. 10/479,238, filed Oct. 20, 2004, Bernds et al.
U.S. Appl. No. 10/492,922, filed Mar. 3, 2005, Buillet et al.
U.S. Appl. No. 10/492,923, filed Dec. 23, 2004, Clemens et al.
U.S. Appl. No. 10/498,610, filed Sep. 29, 2005, Fix et al.
U.S. Appl. No. 10/508,640, filed Dec. 15, 2005, Fix et al.
U.S. Appl. No. 10/508,737, filed May 19, 2005, Bernds et al.
U.S. Appl. No. 10/517,750, filed Oct. 13, 2005, Clemens et al.
U.S. Appl. No. 10/523,216, filed Feb. 2, 2006, Bernds et al.
U.S. Appl. No. 10/523,487, Clemens et al.
U.S. Appl. No. 10/524,646, Fix et al.
U.S. Appl. No. 10/533,756, Clemens et al.
U.S. Appl. No. 10/534,678, Clemens et al.
U.S. Appl. No. 10/535,448, Clemens et al.
U.S. Appl. No. 10/535,449, Fix et al.
U.S. Appl. No. 10/541,815, Gerlt et al.
U.S. Appl. No. 10/541,956, Clemens et al.
U.S. Appl. No. 10/541,957, Fix et al.
U.S. Appl. No. 10/543,561, Clemens et al.
U.S. Appl. No. 10/542,678, Bernds et al.
U.S. Appl. No. 10/542,679, Bernds et al.
U.S. Appl. No. 10/562,989, Ficker et al.
U.S. Appl. No. 10/562,869, Glauert.
U.S. Appl. No. 10/569,763, Fix et al.
U.S. Appl. No. 10/568,730, Clemens et al.
U.S. Appl. No. 10/569,233, Bernds et al.
U.S. Appl. No. 10/570,571, Clemens et al.

Angelopoulos M et al., "In-Situ Radiation Induced Doping", Mol. Crystl. Liq. Cryst., 1990, vol. 189, pp. 221- 225.
Assadi A, et al:, Field-Effect Mobility of Poly (3-Hexylthiophene) Dept. of Physics and Measurement Technology, Received Mar. 3, 1988; accepted for Publication May 17, 1988.
Bao, Z. et al., "High-Performance Plastic Transistors Fabricatecd by Printing Techniques", Chem. Mater vol. 9, No. 6, 1997, pp. 1299-1301.
Bao, Z. et al. "Organic and Polymeric Materials for the Fabrications of Thin Film Field-Effect Transistors", paper presented at the meeting of American Chemical Society, Division of Polymer Chemistry, XX, XX, vol. 39, No. 1, Mar. 29, 1998.
Brabec, C.J. et al, "Photoinduced FT-IR spectroscopy and CW-photocurrent measurements of conjugated polymers and fullerenes blended into a conventional polymer matrix", Solar Energy Materials and Solar Cells, 2000 Elsevier Science V.V., pp. 19-33.
Brabec, C.J. et al., "Photovoltaic properties of a conjugated polymer/methanofullerene composites embedded in a polystyrene matrix", Joumal of Applied Physics, vol. 85, No. 9, 1999, pp. 6866-6872.
Braun D., et al, "Visible light emission from semiconducting polymer diodes", American Institute of Physics, Applied Physics Letters 58, May 6, 1991, pp. 1982-1984.
Brown, A.R. et al., "Field-effect transistors made from solution-processed organic semiconductors", Elsevier Science, S.A., Synthetic Metals 88 (1997) pp. 37-55.
Brown, A.R., "Logic Gates Made from Polymer Transistors and Their Use in Ring Oscillators", Science, vol. 270, Nov. 10, 1995, pp. 972-974.
Chen, Shiao-Shien et al:, "Deep Submicrometer Double-Gate Fully-Depleted SOI PMOS Devices: A Concise Short-Channel Effect Threshold Voltage Model Using a Quasi-2D Approadh", IEEE Transaction on Electron Devices, vol. 43, No. 9, Sep. 1996.
Chen, X.L. et al., "Morphological and Transistor Studies of Organic Molecular Semiconductors with Anisotropic Electrical Characteristics", American Chemical Society, 2001, Chem. Mater. 2001, 13, 1341-1348.
Clemens, W. et al., "Vom Organischen Transistor Zum Plastik-Chip," Physik Journal, V. 2, 2003, pp. 31-36.
Collet J. et al:, Low Voltage, 30 NM Channel Length, Organic Transistors With a Self-Assembled Monoloayer as Gate Insulating Films:, Applied Physics Letters, American Institute of Physics. New York, US, Bd 76, Nr. 14, Apr. 3, 2000, Seiten 1941-1943, XP000950589, ISSN:0003-6951, das ganze Dokument.
Crone, B. et al, "Large-scale complementary Integrated circuits based on Organic transistors", Nature, vol. 403, Feb. 3, 2000, pp. 521-.
Dai, L. et al, Photochemical Generation of Conducting Pattersn in Polybutadiene Films:, Macromolecules, vol. 29, No. 1, 1996, pp. 282-287, XP 001042019, the whole document.
Dai, L. et al., "Conjugation of Polydienes by Oxidants Other Than Iodine", Elsevier Science S.A., Synthetic Metals 86 (1997) 1893-1894.
Dai, L. et al., "$I_2$-Doping" of 1,4-Polydienes*, Elsevier Science S.A., Synthetic Metals 69 (1995), pp. 563-566.
De Leeuw D.M. et al., "Polymeric integrated circuits and light-emitting diodes", Electron Devices Meeting, 1997. Technical Digest, International, Washington, DC, USA Dec. 7-10, 1997, New York, NY, USA, IEEE, US Dec. 7, 1997.
Dodabalapur, A. et al., Organic smart pixels, American Institute of Physics, Applied Physics Letters, vol. 73, No. 2, Jul. 13, 1998, pp. 142-144.
Drury et al., "Low-Cost All-Polymer Integrated Circuits", American Institute of Physics, Applied Physics Letters, 1998, vol. 73, No. 1, pp. 108-110, Jul. 6, 1998.
Ficker, J. et al., "Dynamic and Lifetime Measurements of Polymer OFETS and Integrated Plastic Circuits," Proc. Of SPIE, v. 466, 2001, pp. 95-102.
Fix, W. et al., "Fast Polymer Integrated Circuits Based on a Polyfluorene Derivative", ESSDERC 2002, 2002, pp. 527-529.
Fix, W., et al., "Fast polymer integrated circuits", American Institute of Physics, Applied Physics Letters, vol. 81, No. 89, Aug. 2002, pp. 1735-1737.
Forrest et al.: "The Dawn of Organic Electronics", IEEE Spectrum, Aug. 2000, Seiten 29-34, XP002189000, IEEE Inc., New York, US ISSN:0018-9235, Seite 33, rechte Spalte, Zelle 58-Seite 34, linke Spalte, Zeile 24; Abbildung 5.
Fraunhofer Magazin- Polytronic Chips Von der Rolle, Apr. 2001, pp. 8-13.
Garbassi F., et al., "Bulk Modifications", Polymer Surfaces, John Wiley & Sons, 1998, pp. 289-300.
Garnier F et al:, "Vertical Devices Architecture By Molding Of Organic-Based Thin Film Transistor", Applied Physics Letters, American Institute Of Physics. XP000784120, issn: 0003-6951 abbildung 2.
Garnier, F. et al, "All-Polymer Field-Effect Transistor Realized by Printing Techniques", Science, American Association for the Advancement of Science, US, vol. 265, Sep. 16, 1994, pp. 1684-1686.
Garnier et al., "Conjugated Polymers and Oligomers as Active Material For Electronic Devices", Synthetic Metals, vol. 28, 1989.
Gelinck, G.H. et al., "High-Performance All-Polymer Integrated Circuits", Applied Physics Letters, v. 77, 2000, pp. 1487-1489.
Gosain, D.P., "Excimer laser crystallized poly-Si TFT's on plastic substrates", Second International Symposium on Laser Precision Microfabrication, May 16-18, 2001, Singapore, vol. 4426, pp. 394-400.
Halls, J.J. M., et al., "Efficient photodiodes from interpenetrating polymer networks", Nature, vol. 376, Aug. 10, 1995, pp. 498-500.
Harsanyi G. ET AL, "Polytronics for biogtronics:unique possibilities of polymers in biosensors and BioMEMS", IEEE Polytronic 2002 Conference, Jun. 23, 2002, pp. 211-215.
Hebner, T.R. et al., Ink-jet printing of doped polymers for organic light emitting devices:, American Institute of Physics, Applied Physics Letters, vol. 72, No. 5, Feb. 2, 1998, pp. 519-521.
Hergel, H. J.: "Pld-Programmiertechnologien", Elektronik, Franzis Verlag GMBH. Munchen, DE, Bd 41, Nr. 5, Mar. 3, 1992, Seiten 44-46, XP000293121, ISSN: 0013-5658, Abbildungen 1-3.
Hwang J D et al:, "A Vertical Submicron Slc thin film transistor", Solid State Electronics, Elsevier Science Publishers, Barking, GB, Bd. 38, NR. 2, Feb. 1, 1995, Seiten 275-278, XP004014040, ISSN:0038-1101, Abbildung 2.
IBM Technical Disclosure Bulletin, "Short-Channel Field-Effect Transistor", IBM Corp., New York, US, Bd. 32, Nr. 3A, Aug. 1, 1989, Seiten 77-78, XP000049357, ISSN:0018-8689, das ganze Dokument.
Kawase, T., et al., "Inkjet Printed Via-Hole Interconnections and Resistors for All-Polymer Transistor Circuits", Advanced Materials 2001, 13, No. 21, Nov. 2, 2001, pp. 1601-1605.
Klauk, H. et al., "Fast Organic Thin Film Transistor Circuits", IEEE Electron Device Letters, vol. 20, No. 6, pp. 289-291.
Klauk, H. et al., "Pentacene Thin Film Transistors and Inverter Circuits", 1997 International Exectron Devices Meeting Technical Digest, pp. 539-542, Dec. 1997.
Knobloch, A. et al., "Printed Polymer Transistors", Proc. Polytronic, v. 84, 2001, pp. 84-89.
Kobel W. et al., "Generation of Micropatterns in Poly (3-Methyl-Thiophene) Films Using Microlithography: A First Step in the Design of an All-Organic Thin-Film Transistor" Synthetic Metals, V. 22, 1988, pp. 265-271..
Koezuka, H. et al., "Macromolecular Electronic Device", Mol. Cryst. Liq. Cryst. 1994, vol. 2555, pp. 221-230.
Kuhlmann et al., "Terabytes in Plastikfolie", Organische Massenspeicher vor der Serienproduktion.
Kumar, Anish et al:, "Kink-Free Polycrystalline Silicon Double-Gate Elevated-Channel Thin-Film Transistors", IEEE Transactions on Electron Devices, vol. 45, No. 12, Dec. 1998.
Lidzey, D. G. et al., "Photoprocessed and Micropatterned Conjugated Polymer LEDs", Synthetic Metals, V. 82, 1996, pp. 141-148.
Lowe, J. et al., "Poly (3-(2-Acetoxyethyl)Thiophene): A Model Polymer for Acid-Catalyzed Lithography", Synthetic Metals, Elsevier Sequoia, Lausanne, CH, Bd. 85, 1997, Seiten 1427-1430.
Lu, Wen et al., "Use of Ionic Liquids for π-Conjugated Polymer Electrochemical Devices", Science, vol. 297, 2002, pp. 983-987/.

Lucent Technologies, "Innovation marks significant milestone in the development of electronic paper", Cambridge, MA and Murray Hill, NJ, Nov. 20, 2000. XP-002209726.
Manuelli, Alessandro et al., "Applicability of Coating Techniques for the Production of Organic Field Effect Transistors", IEEE Polytronic 2002 Conference, 2002, pp. 201-204.
Miyamoto, Shoichi et al:, Effect of LDD Structure and Channel Poly-Si Thinning on a Gate-All-Around TFT (GAT) for SRAM's, IEEE Transactions on Electron Devices. vol. 46, No. 8, Aug. 1999.
Nalwa, H.S., "Organic Conductive Milecules and Polymers", vol. 2, 1997, pp. 534-535.
Oelkrug, D. et al., "Electronic spectra of self-organized oligothiophene films with 'standing' and 'lying' molecular units", Elsevier Science S.A., 1996, Thin Solid Films 284-270.
Qiao, X. et al., "The FeCl3-doped poly3-alkithiophenes) in solid state", Elsevier Science, Synthetic Metals 122 (2001) pp. 449-454.
Redecker, M. et al., "Mobility enhancement through homogeneous nematic alignment of a liquid-crystalline polyfluorene", 1999 American Institute of Physics, Applied Physics Letters, vol. 74, No. 10, pp. 1400-1402.
Rogers J A et al:, "Low-Voltage 0.1 Mum Organic Transistors and Complementary Inverter Circuits Fabricated with a Low-Cost Form of Near-Field Photolithography", Applied Physics Letters, American Institute of Physics. New York, US, Bd. 75, Nr. 7, Aug. 16, 1999, Seiten 1010-1012, XP000934355, ISSN: 003-6951, das ganze Dokument.
Rogers, J. A. et al:, "Printing Process Suitable for Reel-to-Reel Production of High-Performance Organic Transistors and Circuits", Advanced Materials, VCH, Verlagsgesellschaft, Weinheim, DE, Bd. 11, Nr. 9, Jul. 5, 1999, Seiten 741-745, P000851834, ISSN: 0935-9648, das ganze Dokument.
Roman et al., "Polymer Diodes With High Rectification", Applied Physics Letters, vol. 75, No. 21, Nov. 22, 1999.
Rost, Henning et al., "All-Polymer Organic Field Effect Transistors", Proc. Mat Week, CD, 2001, pp. 1-6.
Sandberg, H. et al, "Ultra-thin Organic Films for Field Effect Transistors", SPIE vol. 4466, 2001, pp. 35-43.
Schoebel, "Frequency Conversion with Organic-On-Inorganic Heterostructured Diodes", Extended Abstracts of the International Conference on Solid State Devices and Materials, Sep. 1, 1997.
Schrodner M. et al., "Plastic electronics based on Semiconducting Polymers", First International IEEE Conference on Polymers and Adhesives in Microelectronics and Photonics. Incorporating Poly, Pep & Adhesives in Electronics. Proceedings (Cat. No. 01TH8592), First International IEEE Conference on Polymers and Adhesives in Micr, Seitenn 91-94.
Shaheen, S.E., et al., "Low band-gap polymeric photovoltaic devices", Synthetic Metals, vol. 121, 2001, pp. 1583-1584.
Speakman, S.P. et al., High performance organic semiconducting thin films: Ink Jet printed polythophene [*rr*-P3HT], Organic Electronics 2(2), 2001, pp. 65-73.
Takashima, W. et al., Electroplasticity Memory Devices Using Conducting Polymers and Solid Polymer Electrolytes, Polymer International, Melbourne, 1992, pp. 249-253.
Ullman, A. et al., "High Performance Organic Field-Effect Transistors and Integrated Inverters", Mat. Res. Soc. Symp. Proc., v. 665, 2001, pp. 265-270.
Velu, G. et al. "Low Driving Voltages and Memory Effect in Organic Thin-Film Transistors With A Ferroelectric Gate Insulator", Applied Physics Letters, American Institute of Physics, New York, Vo.l 79, No. 5, 2001, pp. 659-661.
Wang, Hsing et al., "Conducting Polymer Blends: Polythiophene and Polypyrrole Blends with Polystyrene and Poly(bisphenol A carbonate)", Macromolecules, 1990, vol. 23, pp. 1053-1059.
Wang, Yading et al., "Electrically Conductive Semiinterpenetrating Polymer Networks of Poly(3-octylthiophene)", Macromolecules 1992, vol. 25, pp. 3284-3290.
Yu, G. et al., "Dual-function semiconducting polymer devices: Light-emitting and photodetecting diodes", American Institute of Physics, Applied Physics Letter 64, Mar. 21, 1994, pp. 1540-1542.
Zangara L., "Metall Statt Halbleiter, Programmierung Von Embedded ROMS Ueber Die Metallisierungen", Elektronik, Franzis Verlag GmbH, Munchen, DE, Vol. 47, No. 16, Aug. 4, 1998, pp. 52-55.
Zheng, Xiang-Yang et al., "Electrochemical Patterning of the Surface of Insulators with Electrically Conductive Polymers", J. Electrochem. Soc., v. 142, 1995, pp. L226-L227.
Zie Voor Titel Boek, de 2e Pagina,XP-002189001, pg. 196-228.
U.S. Appl. No. 10/585,775, Fix.
U.S. Appl. No. 11/574,139, Ficker.

* cited by examiner

FIG 1
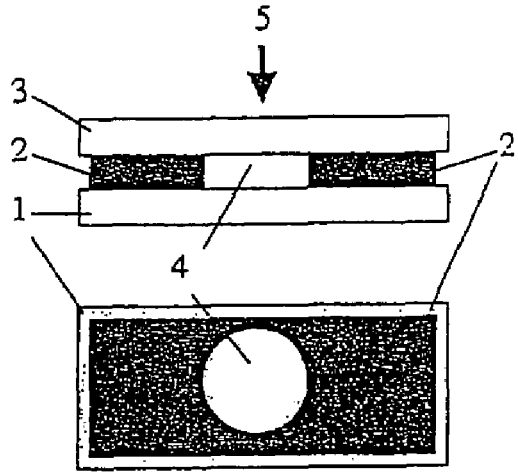
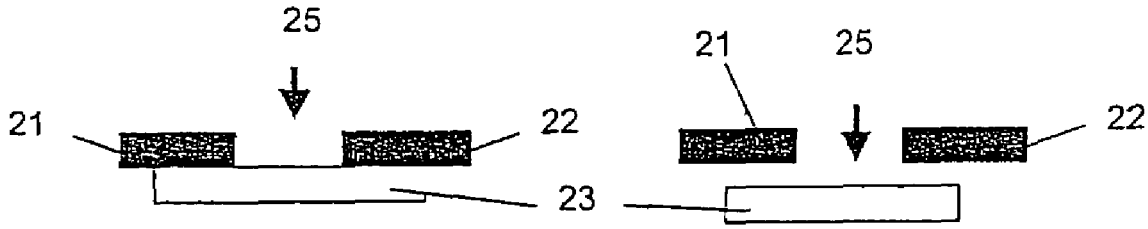
FIG 2

MECHANICAL CONTROL ELEMENTS FOR ORGANIC POLYMER ELECTRONIC DEVICES

For any type of electronic devices, the deliberate control of the electronic devices is an important point. In the aborning field of polymer electronic devices, too, this will be necessary and enables entirely new applications for these electronic devices. The electronic devices can be influenced by a mechanical pushbutton element. It is thus possible to switch or to influence electrical signals or material constants.

Taking this as a departure point, the invention is based on the object of providing a maximally cost-effective and compatible switching element for polymer electronic devices.

This object is achieved by means of the inventions specified in the independent claims. Advantageous refinements emerge from the dependent claims.

Accordingly, a switching element, in particular a pushbutton element, for the mechanical switching of polymer electronic devices has conducting and nonconducting organic substances or comprises such substances. The organic substances are polymers, in particular. A combination of organic materials with conventional materials such as metals, for instance, is also possible.

This obviates the interconnection of nonpolymeric pushbutton units with polymeric circuits. By virtue of the polymeric pushbutton or switching element, on the one hand the advantages of polymer electronic devices such as flexibility, cost-effectiveness and printability can be utilized for the switching element itself; on the other hand, however, the major advantage is also afforded that the switching element can be produced together with the electronic devices.

The electronic devices can be influenced permanently, reversibly and temporarily by the mechanical switching element. For this purpose, the switching element can for example be mechanically switched reversibly or irreversibly.

Alternatively or supplementarily, the switching element is a switching element which changes one of its electrical values, in particular its capacitance, analogously, that is to say for example proportionally or logarithmically, with the magnitude of the pressure exerted on the switching element.

In one preferred variant, the switching element has two organic conduction elements situated opposite one another, for example in the form of electrodes and/or contact elements, which are separated by an insulating organic layer having an opening. In particular, one of the two organic conduction elements is then flexible, so that it can be pressed through the opening in the insulating organic layer onto the other organic conduction element. If the conduction element is elastically deformable in this case, then a contact is thereby closed reversibly, that is to say temporarily. If, by contrast, the conduction element is plastically deformable, then the contact is permanently closed.

In another variant, the switching element has three organic conduction elements, of which two are conductively connected by the third and the third can be removed from the first two conduction elements by pressure in order to interrupt the electrical conduction. It is thereby possible to realize a contact which can be disconnected by pressure. For this purpose, the third conduction element may be mounted in resilient fashion or be flexible itself. In the latter case, a reversible or irreversible switching behavior results depending on whether the third conduction element is plastically or elastically deformable.

For a contact that is interrupted by pressure, the switching element may also have an organic conduction element and means by which the conduction element can be interrupted if pressure is exerted on them.

Alternatively or supplementarily, the switching element may have an organic transistor, in particular a field effect transistor, the current of which can be controlled by pressure on the switching element.

In a method for producing a switching element, the latter is embodied with or in conducting and insulating organic substances. Advantageous refinements of the method emerge analogously to the advantageous refinements of the switching element, and vice versa.

Further advantages and features of the invention emerge from the description of an exemplary embodiment with reference to the drawing, in which FIG. 1 shows a switching element in the form of a mechanical pushbutton element which can be switched in conducting fashion by pressure;

FIG. 2 shows a switching element in the form of a mechanical pushbutton element which can be switched in nonconducting fashion by pressure;

Figure 3:
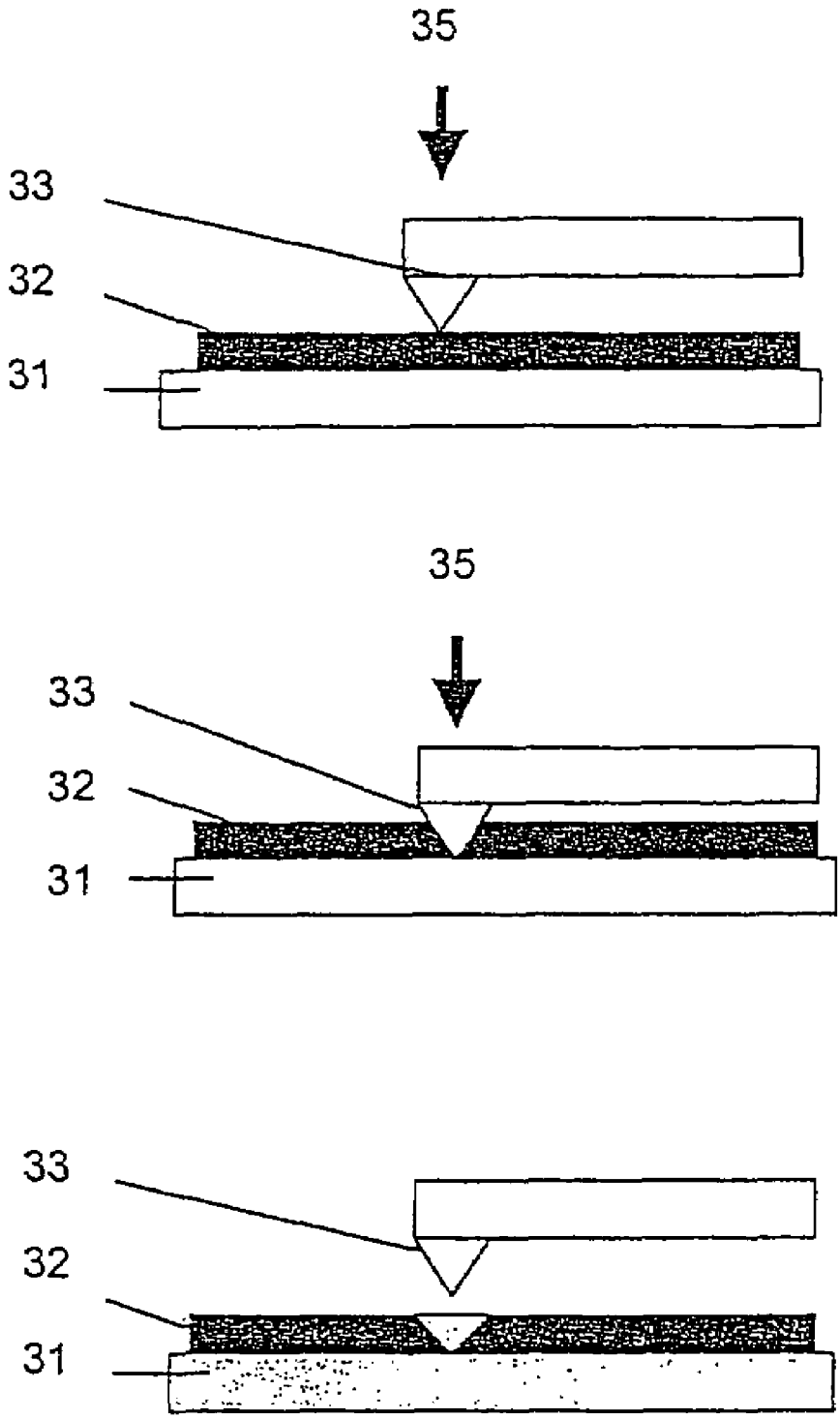
FIG. 3 shows a switching element in the form of a mechanically irreversible pushbutton element which can be switched in nonconducting fashion by pressure.

Organic substances or materials, in particular polymers, are used for the construction of switching elements. Use is preferably made of typical organic materials of polymer electronic devices, such as, for example, conducting, nonconducting, insulating, flexible polymers. The exemplary embodiments can be differentiated into three classes:

a) mechanically reversible pushbutton elements, in the case of which multiple triggering is possible and which exhibits a digital switching behavior;

b) mechanically irreversible pushbutton elements, in the case of which only single triggering is possible and which exhibits a digital switching behavior;

c) pressure-sensitive pushbutton elements having an analog switching behavior.

FIGS. 1 and 2 show examples for class a). FIG. 1 shows two conduction elements 1 and 3 situated opposite one another in the form of electrodes, which are electrically isolated by an insulating layer 2. The conduction elements 1 and 3 are made of a conducting polymer, and the insulating layer 2 is made of a nonconducting polymer. Said layer 2 has a defined opening 4. As soon as a mechanical pressure 5 is exerted on the flexible conduction element 3, an electrical short circuit arises between the conduction elements 1 and 3 and an electric current flows or an electrical signal is passed on. If pressure is exerted by both, both conduction elements 1 and 3 may also be configured in flexible fashion. The pressure required for triggering can be set by way of the thickness of the insulating layer 2 and the size of the opening 4. A repeatable switching behavior is made possible by means of the reversibly elastic behavior of the material of the flexible conduction element 3.

It is likewise possible to reverse the switching behavior, that is to say that a permanent electrical conduction can be disconnected by mechanical pressure. A switching element suitable for this is illustrated in FIG. 2. It has three conduction elements 21, 22, 23 in the form of contacts. The first two conduction elements 21, 22 are connected to one another by the third conduction element 23. As soon as a mechanical pressure 25 is exerted, the third conduction element 23 is removed from the first two conduction elements 21, 22 and the electrical contact is interrupted.

The application of class b) is in turn divided into two possibilities. Firstly it is possible to produce an irreversible conductivity between two electrodes, and secondly an existing conductivity may be interrupted irreversibly. In FIG. 3, a conduction element 32 in the form of an electrical conductor track on a substrate 31 is permanently isolated by means of a mechanical pressure 35 onto a harder polymer part 33. For this purpose, the hardware polymer part 33 has a tip or cutting edge which separates the electrical conductor track 32.

The possibility of permanently producing a conductive connection is identical in construction to the exemplary embodiment of FIG. 1 except that the conductive materials used, in the case of a single connection, hold together permanently and thus produce a short circuit. In addition, the thickness of the insulating layer may be adapted.

Figure 4:
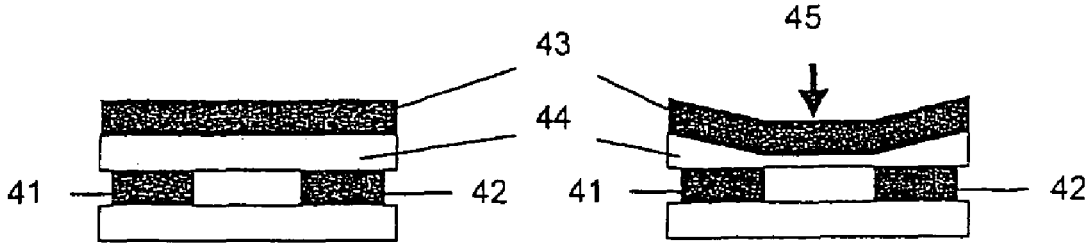
FIG. 4 shows a switching element in the form of a pressure-sensitive pushbutton element in which the pressure exerted on the switching element can be measured.

Switching elements of class c) are capacitive switches, for example, which change their capacitance as a result of mechanical pressure. FIG. 4 illustrates an organic field effect transistor, the current of which from the source 41 to the drain 42 is controlled by an electric field to the gate electrode 43. The field is dependent on the thickness of the insulator 44, which in turn depends on the mechanical pressure 45 applied to the electrode. This enables an analog switching behavior depending on the pressure. In order to digitize this switching behavior, it is readily possible to connect an organic field effect transistor downstream.

A further embodiment has a construction like that illustrated in FIG. 1, but the insulating layer is embodied in continuous fashion without a hole and such that it can be perforated by pressure. For this purpose, the insulating layer may be embodied as a very thin layer and/or at least one of the conduction elements 2, 3 in the form of layers contains rough particles, such as metal and/or graphite particles, for instance.

Yet another embodiment has a construction like that illustrated in FIG. 1, but the insulating layer contains conductive particles, for instance metal and/or graphite particles, and is preferably embodied in continuous fashion without a hole. A conductive path is then produced by pressure.

Various combinations of the switch types presented are also possible.

Polymeric switching elements or switches can be produced extremely favorably on account of the material and production costs. The materials are themselves flexible and can be applied on large-area, flexible substrates without any problems. A further important point is the possibility afforded for problem-free integration of these switches into organic circuits such as are used in polymer electronic devices. This integration enables completely new applications in polymer electronic devices, such as, for example, all polymers, cost-effective electronic game devices for single use.

The invention claimed is:

1. A printed mechanical polymeric switching device for the mechanical switching of electronic devices, comprising:

a substrate; and a mechanical polymeric switching element on the substrate, the element comprising conducting and insulating organic substances applied to the substrate by printing.

2. The printed polymeric switching device as claimed in claim 1, wherein the switching element is arranged to be switched mechanically reversibly.

3. A polymeric circuit including a printed polymeric switching device as claimed in claim 2.

4. The printed polymeric switching device as claimed in claim 1 wherein the switching element exhibits a given electrical parameter value and is arranged to be responsive to an applied pressure which changes the electrical parameter value in response to the magnitude of the pressure exerted on the switching device.

5. The a printed polymeric switching device of claim 4 wherein the electrical parameter value is capacitance.

6. A polymeric circuit including a printed polymeric switching device as claimed in claim 4.

7. The printed polymeric switching device as claimed in claim 1 wherein the switching device includes two organic conduction elements situated opposite one another on the substrate, which conduction elements are separated by an insulating organic layer having an opening.

8. The printed polymeric switching device as claimed in claim 7 wherein one of the organic conduction elements is flexible, so that it can be pressed through the opening in the insulating organic layer onto the other organic conduction element.

9. A polymeric circuit including a printed polymeric switching device as claimed in claim 8.

10. A polymeric circuit including a printed polymeric switching device as claimed in claim 7.

11. The printed polymeric switching device as claimed in claim 1 wherein the switching device includes a plurality of organic conduction elements, of which two conduction elements are conductively connected by a third conduction element and the third conduction element is arranged to be removable from the other two conduction elements by applied pressure.

12. A polymeric circuit including a printed polymeric switching device as claimed in claim 11.

13. The printed polymeric switching device as claimed in claim 1 including an organic conduction element on the substrate and an arrangement on the substrate for interrupting conduction of the conduction element.

14. A polymeric circuit including a printed polymeric switching device as claimed in claim 13.

15. The printed polymeric switching device as claimed in claim 1 wherein the switching device includes an organic transistor on the substrate, the current of which is controlled by pressure.

16. A polymeric circuit including a printed polymeric switching device as claimed in claim 15.

* * * * *